United States Patent [19]

Ono

[11] 4,440,211

[45] Apr. 3, 1984

[54] APPARATUS FOR HOISTING ROLL SEGMENTS IN CONTINUOUS CASTING EQUIPMENT

[75] Inventor: Kuniaki Ono, Nara, Japan

[73] Assignee: Hitachi Shipbuilding & Engineering Company Limited, Osaka, Japan

[21] Appl. No.: 364,687

[22] Filed: Apr. 2, 1982

[51] Int. Cl.[3] ..... B22D 11/128

[52] U.S. Cl. ..... 164/442; 164/448

[58] Field of Search ..... 164/441, 442, 447, 448

[56] References Cited

U.S. PATENT DOCUMENTS 4,223,715 9/1980 Streubel ..... 164/448

FOREIGN PATENT DOCUMENTS 55-117547 9/1980 Japan ..... 164/448

*Primary Examiner*—Kuang Y. Lin

*Attorney, Agent, or Firm*—Joseph W. Farley

[57] ABSTRACT

In continuous casting equipment having a path of transport of castings defined by roll segments and having a curved section and a horizontal section, an apparatus for hoisting the roll segment comprises a pair of pivotal guide rods pivotably supported by a trolley disposed above the horizontal section, a pair of fixed guide rods arranged on the opposite sides of each of the roll segments defining the curved section, and a pair of fixed circular arc rails extending along the paths of movement of the free ends of the pivotal guide rods. A truck, movable on the rails and engageable with the pivotal guide rods, is reciprocatable along the rails to align the pivotal guide rods with a desired pair of fixed guide rods for hoisting the corresponding roll segment along the fixed guide rods to the pivotal guide rods in alignment therewith. Pairs of cavities are formed in the rails in corresponding relation to the pairs of fixed guide rods, and a pair of rear wheels on the truck, when engaged in the desired pair of cavities, locks the truck to the rails reliably, whereby the pivotal guide rods engaged with the truck are indirectly locked to the rails.

5 Claims, 6 Drawing Figures

APPARATUS FOR HOISTING ROLL SEGMENTS IN CONTINUOUS CASTING EQUIPMENT

The present invention relates to an apparatus for hoisting a support frame having a pair of casting guide rolls supported thereon (which frame will hereinafter be referred to as a "roll segment") in continuous casting equipment, and more particularly to an apparatus which is capable of hoisting any one of roll segments defining a path of transport of castings even when the transport path comprises a curved section and a horizontal section.

Casting guide rolls for use in continuous casting equipment are subject to wear or thermal cracking due to contact with castings over a prolonged period of time and must therefore be repaired or replaced occasionally. In such a case, the roll segment concerned is removed from the path of transport of castings by hoisting. Various apparatus have heretofore been proposed for this purpose.

Published unexamined Japanese patent application No. 55-117547 discloses a roll segment hoisting apparatus for use in continuous casting equipment wherein a path of transport of castings is defined by a plurality of roll segments and has a curved section and a horizontal section. The disclosed apparatus comprises a crane disposed movably above the horizontal section, a pair of pivotal guide rods pivotally movably supported by the crane, a pair of fixed guide rods arranged on the opposite sides of each of the roll segments defining the curved section, a pair of fixed circular arc rails extending along the paths of movement of the free ends of the pivotal guide rods, a truck having a pair of front wheels and a pair of rear wheels movable on the rails, means for engaging the truck with the pivotal guide rods, means for reciprocating along the rails the truck in engagement with the pivotal guide rods, means for locking the pivotal guide rods in a position where the guide rods are continuous with the pair of fixed guide rods individually, and means for hoisting the corresponding roll segment along the fixed guide rods to the pivotal guide rods when the pivotal guide rods are made continuous with the fixed guide rods. The locking means comprises cylinder assemblies mounted on the pivotal guide rods and a pair of engaging members each projecting from each of the circular arc rails at a location corresponding to each of the fixed guide rods and engageable with the piston rod of the cylinder assembly when the piston rod is extended.

The above apparatus, although installed singly, is adapted to hoist any roll segment from either of the curved section and horizontal section of the casting transport path, and in this sense, the apparatus is much more advantageous in respect of operability, cost and installation space than the usual arrangement wherein two separate apparatus are provided for the curved section and the horizontal section individually. However, the locking means for the pivotal guide rods of the foregoing construction has the following drawbacks.

1. It is difficult to position the piston rods properly for engagement with each pair of engaging members. To turn the pivotal guide rods, i.e. to position the piston rods for engagement with the engaging member, the truck is reciprocated on the circular arc rails as by a chain or wire, but it is difficult to stop the truck at the location where each piston rod is in alignment with the corresponding engaging member. Accordingly the piston rod must be engaged with the engaging member usually by temporarily pulling up the truck to a higher level, extending the piston rod at the pulled-up position and thereafter slightly retracting the truck to the proper position. This procedure is cumbersome and ineffecient.
2. If the truck is pulled up while the piston rod is still in its extended position due to a malfunction of the cylinder assembly, the piston rod would strike against the adjacent engaging member from below to cause damage.

The object of the present invention is to overcome these problems and to provide a hoisting apparatus which operates reliably with stability.

To fulfill this object, the invention provides a roll segment hoisting apparatus for use in continuous casting equipment having a path of transport of castings which is defined by a plurality of roll segments and has a curved section and a horizontal section. The apparatus comprises a trolley provided movably above the horizontal section, a pair of pivotal guide rods pivotably supported by the trolley, a pair of fixed guide rods arranged on the opposite sides of each of the roll segments defining the curved section, a pair of fixed circular arc rails extending along the paths of movement of the free ends of the pivotal guide rods, a truck having a pair of front wheels and a pair of rear wheels movable on the rails, means for engaging the truck with the pivotal guide rods, means for reciprocating the truck along the rails together with the pivotal guide rods in engagement with the truck, means for locking the pivotal guide rods in a position where the guide rods are continuous with the pair of fixed guide rods individually, and means for hoisting the corresponding roll segment along the fixed guide rods to the pivotal guide rods when the pivotal guide rods are made continuous with the fixed guide rods, the locking means being in the form of pairs of cavities formed in suitable portions of the circular arc rails, the rear wheels of the truck being positionable in each of the pairs of cavities to lock the truck to the rails, whereby the pivotal guide rods when in engagement with the truck are indirectly locked to the rails.

With the locking means described above, the engagement of the rear wheels in the pair of cavities automatically determines the position in which the pivotal guide rods are to be locked, so that the guide rods are positionable properly without necessitating the cumbersome procedure needed for the conventional cylinder-engaging member arrangement. Further if the truck is forcibly pulled up while the locking means is in operation, i.e. while the rear wheels are positioned in the cavities, the rear wheels will move out of the cavities. Whereas the conventional locking means is likely to suffer damage due to a malfunction, this eliminates such a likelihood.

According to a preferred embodiment of the invention, the center of curvature of the circular arc rails is positioned above the center of curvature of the curved section of the casting transport path.

When the locking means is provided as pairs of cavities formed in the circular arc rails, it is intended to cause the rear wheels of the truck to fall into the pair of cavities under gravity, so that there is the need to increase the component of gravity on the truck acting toward the bottom of the cavity in order to assure a locked state, but this component of gravity invariably decreases upward along the rail which is in the form of an arc. With the above embodiment, the center of curvature of the rail is positioned above the center of curvature of the curved section of the transport path to render the inclination of the upper portion of the rail smaller than otherwise and thereby increase the component of gravity acting toward the bottom of the cavity to the greatest possible extent.

According to another embodiment of the invention, the hoisting apparatus is provided with holding means for preventing the rear wheels of the truck from falling into some of the cavities.

If the rear wheels of the truck are allowed to fall into every pair of the cavities, it is impossible to operate the apparatus. The rear wheel portion of the truck is therefore usually held raised by the holding means to cause the rear wheels to fall only into the desired pair of cavities.

Various features and advantages of the invention will become apparent from the following description of embodiments given with reference to the accompanying drawings, in which.

Figure 1:
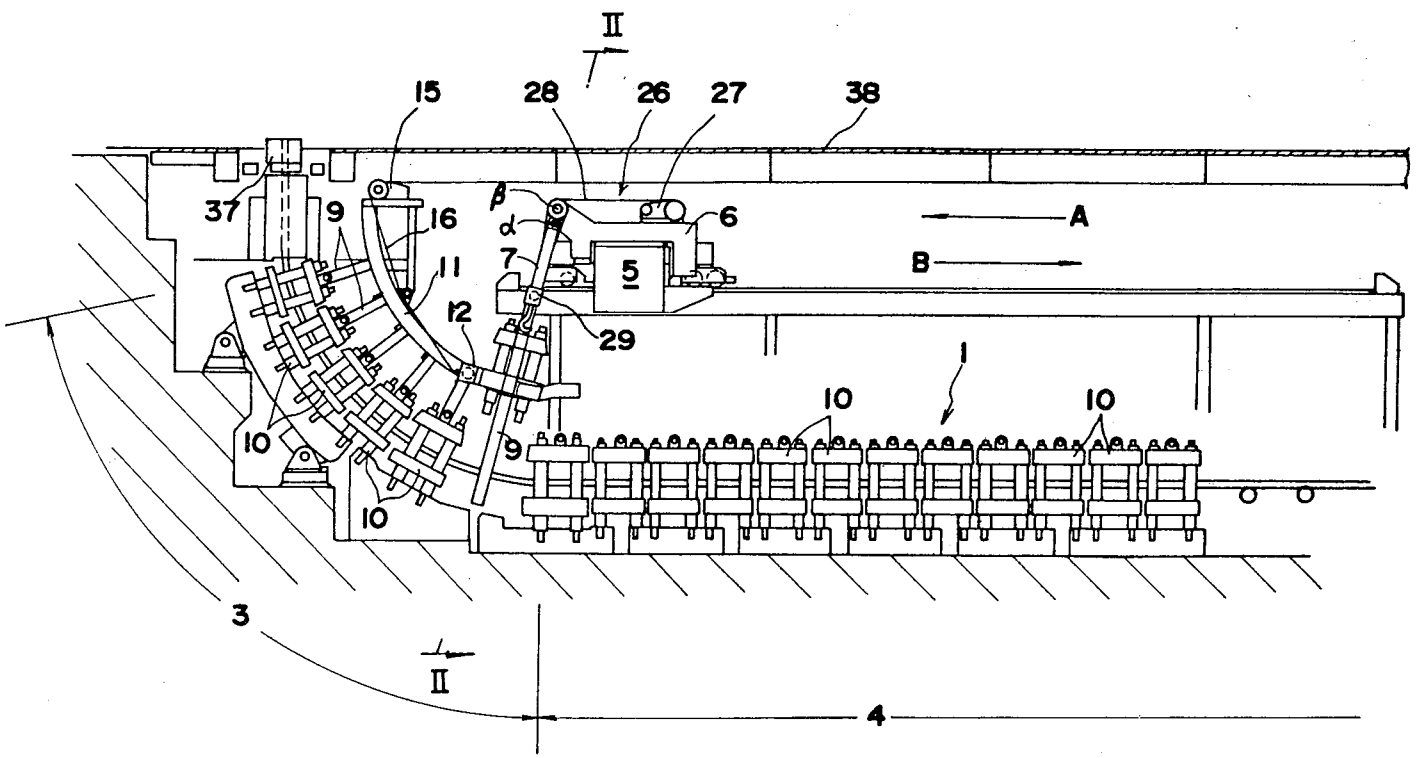
FIG. 1 is a side elevation schematically showing a hoisting apparatus of the invention in its entirety.

FIGS. 1 to 6 show an embodiment for use in equipment for continuously casting two strips 1 and 2. Since the lines for guiding these strips 1 and 2 are of identical construction, the embodiment will be described below as it is used for the cast strip 1 only.

The equipment has a path of transport of the casting 1 including a curved section 3 and a horizontal section 4. A travelling overhead crane 5 disposed above the horizontal section 4 is movable along the horizontal section 4 in reciprocation and has a crab 6 which is movable in horizontal directions C, D at right angles with the directions A, B of reciprocation of the crane 5.

A pair of pivotal guide rods 7 is pivotably suspended from a horizontal rod 8 on the crab 6. Fixed guide rods 9 having the same cross section as the rods 7 are arranged on the opposite sides of each of roll segments 10 defining the curved section 3. The pair of fixed guide rods 9 is in alignment with a phantom line extending from the center of curvature, $\alpha$, of the curved section 3 to the roll segment 10. A pair of fixed circular arc rails 11 disposed above the curved section 3 extends along the paths of movement of the free ends of the pivotal guide rods 7 and has a center of curvature, $\beta$, above the center of curvature $\alpha$. A truck 12, which is in the form of a channel when seen from above, is movable along the rails 11 and has a pair of front wheels 13 and a pair of rear wheels 14 which are fitted in and guided by the rails 11. Wire ropes 16 paid off from a truck lift 15 are tied at their forward ends to connectors 17 at the front end of the truck 12. The truck 12 is pulled up in the direction of arrow E when the wire ropes 16 are wound up by the lift 15 but is allowed to fall under gravity in the direction of arrow F when the ropes 16 are paid off.

Figure 6:
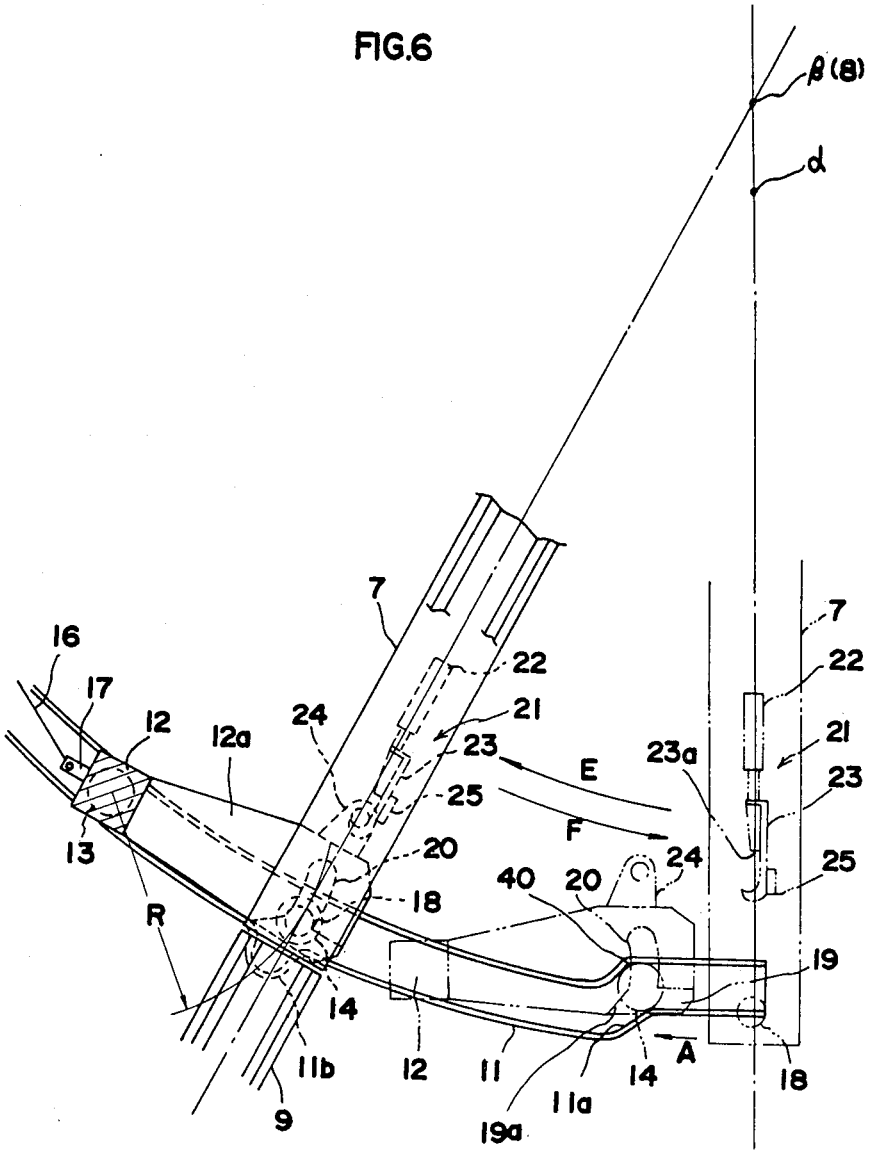
FIG. 6 is a view in section taken along the line VI—VI in FIG. 3.

A rear end portion of each rail 11 is bent upward as seen in FIG. 6. When the truck 12 descends to the lowermost level, each rear wheel 14 of the truck 12 rides onto a slope 11*a* of the rear end portion as indicated in phantom line in FIG. 6, slightly raising the rear portion of the truck 12.

Each of two bars 12*a* of rectangular cross section forming the rear portion of the truck 12 is formed, in the bottom of its rear end, with a passage cutout 19 through which a roll 18 mounted on the free end of each pivotal guide rod 7 passes and also with an elongated engaging groove 20 for the roll 18 to fit in, the groove 20 being in communication with the cutout 19. When advancing into the cutout 19, the roll 18 opposes a slanting face 19*a* defining the cutout 19. For the reason to be given later, the engaging groove 20 extends along a circular arc centered about the axis of the truck front wheel 13.

The circular arc rails 11 are formed with pairs of cavities 11*b* as positioned in corresponding relation to the pairs of fixed guide rods 9. The engagement of the rear wheels 14 of the truck 12 in one of the pairs of cavities 11*b* locks the truck 12 and the pivotal guide rods 7 in engagement with the truck. When the rear wheels fall into the cavities, the rear portion of the truck turns about the front wheel 13, so that the engaging grooves 20 are shaped in the form of a circular arc as already mentioned to enable the rolls 18 to move into the grooves 20 smoothly.

To cause the truck rear wheel 14 to fall into a pair of cavities 11*b* at the desired position only, the apparatus is provided with holding means 21 which comprises a pair of cylinders 22 mounted on the pivotal guide rods 7 individually, a hook 23 attached to the piston rod of each cylinder 22, and an engaging member 24 mounted on a rear end upper portion of each of the bars 12 of the truck and engageable with the hook 23. Indicated at 25 is a support plate for guiding the hook 23 on the rear side thereof.

A device 26 for hoisting the roll segment 10 comprises a winch 27 mounted on the crab 6 for winding up wire ropes 28, a vertically movable beam 29 suspended by the wire ropes 28 and carrying at its opposite ends rolls 30 fitting in the pivotal guide rods 7 and movable therealong, and hooks 32 turnably suspended from the shaft 31 of the rolls 30. Pulleys 33 for supporting the wire ropes 28 are mounted on the horizontal rod 8 supporting the pivotal guide rods 7.

Figure 2:
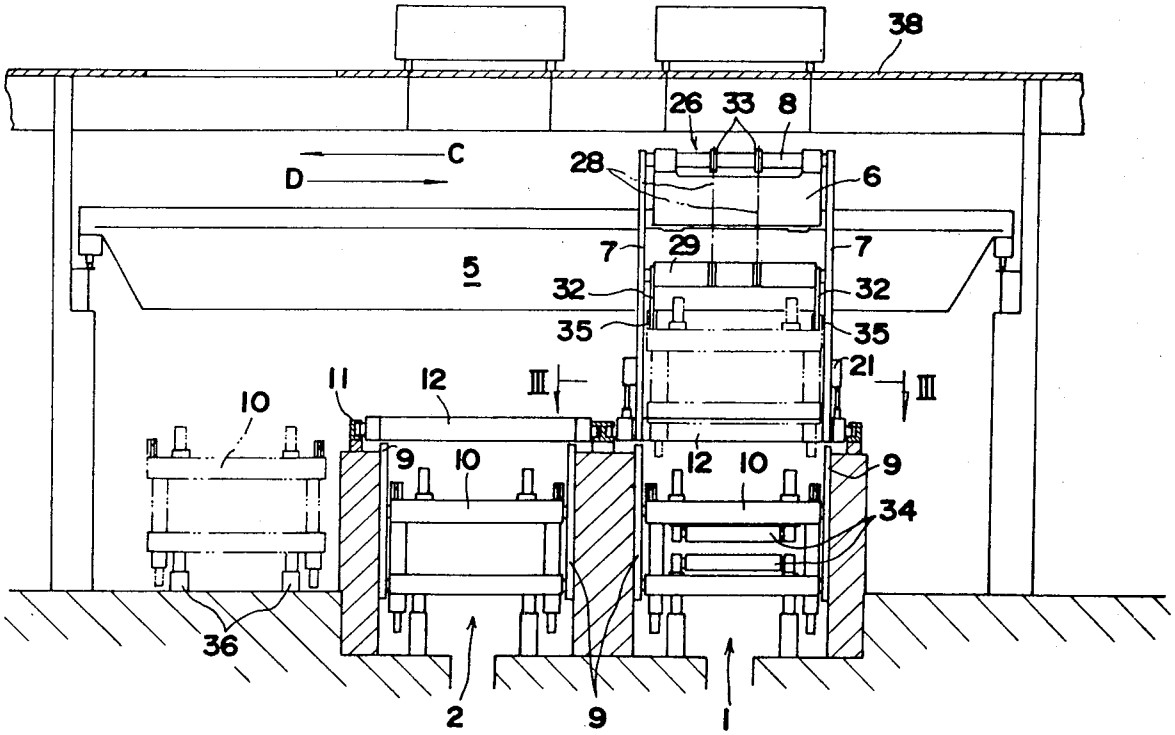
FIG. 2 is an enlarged view in section taken along the line II—II in FIG. 1.
Figure 3:
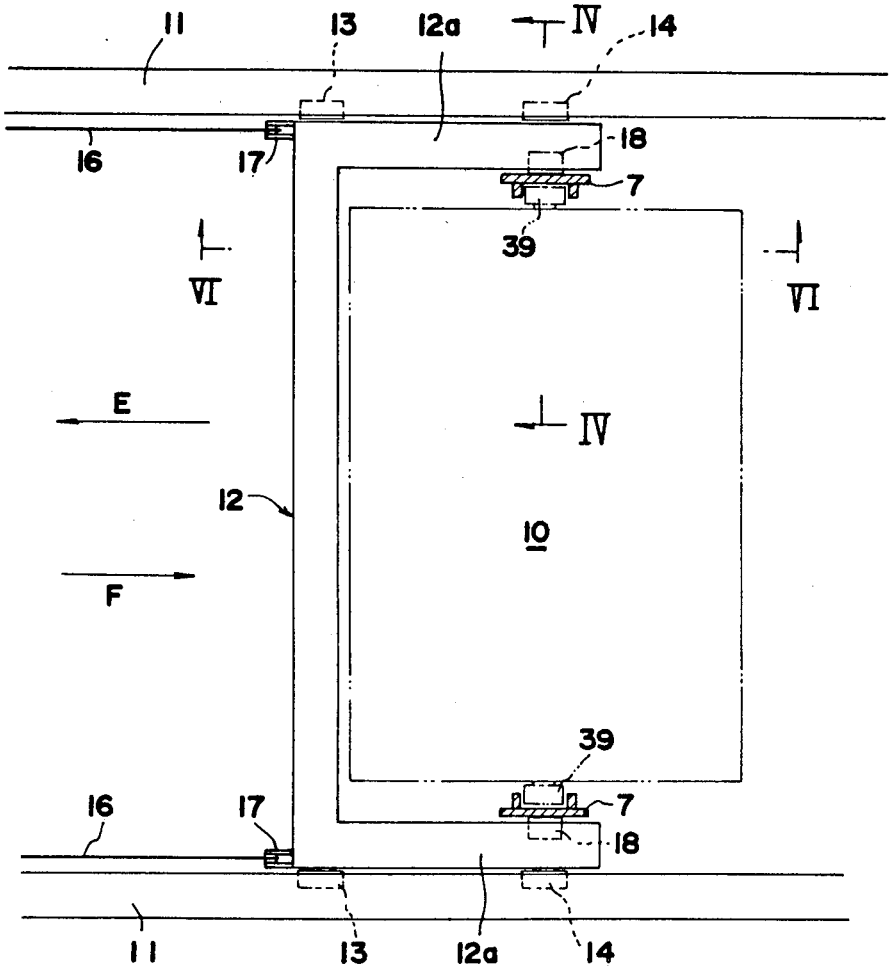
FIG. 3 is an enlarged view in section taken along the line III—III in FIG. 2.
Figure 4:
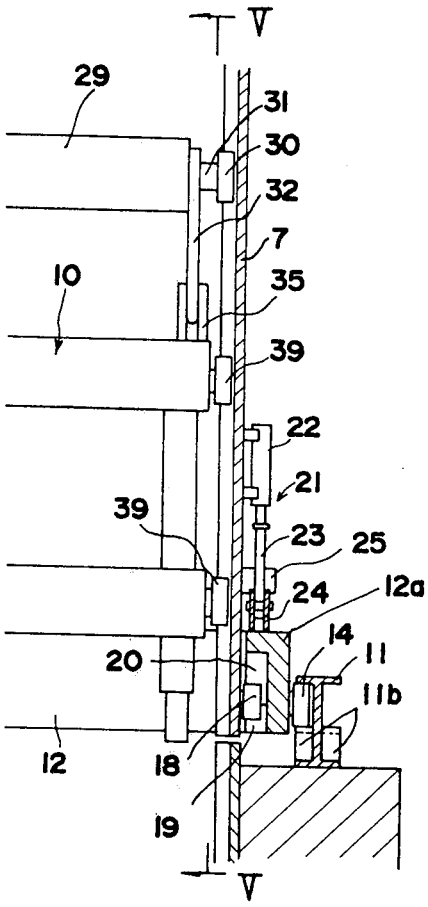
FIG. 4 is a view in section taken along the line IV—IV in FIG. 3.
Figure 5:
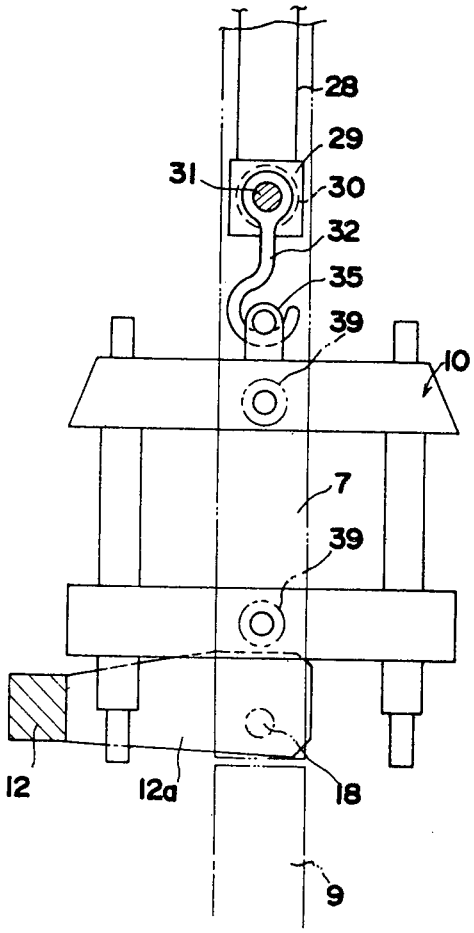
FIG. 5 is a view in section taken along the line V—V in FIG. 4.

As seen in FIG. 2, each of the segments 10 includes a pair of casting guide rolls 34 supported thereon and has handles 35 projecting from its top for engagement with the hooks 32. Indicated at 36 is a segment support beside the transport path, at 37 a mold and at 38 a floor.

The hoisting apparatus operates in the following manner. The crane 5 above the horizontal section 4 is brought to above the junction of the section 4 and the curved section 3 to position the horizontal rod 8, about which the pivotal guide rods 7 turn, at the center of curvature, $\beta$, of the circular arc rails 11 immediately above the center of curvature, $\alpha$, of the curved section 3. With this movement of the crane 5, the pivotal guide rods 7 suspended from the crab 6 also move in the direction of arrow A in FIG. 6, causing the rolls 18 on the rods 7 to advance into the passage cutouts 19 of the truck 12 waiting as indicated in phantom lines in FIG. 6. Simultaneously with the striking contact of the rolls 18 with the slanting faces 19*a*, the hooks 23 of the holding means 21 also strike against lateral pins on the engaging members 24. The striking contact of these members pushes the truck 12 forward, while abutting portions 23*a* formed on the hooks 23 depress the lateral pins on the engaging members 24, with the result that the rear wheels 14 of the truck roll down the slopes 11*a* without being held at the position of bent points 40 of the rails 11, permitting the rolls 18 to engage in the grooves 20. Consequently the truck 12 is connected to the pivotal guide rods 7. With the hooks 25 in engagement with the engaging members 24 at this time, the truck 12 is held suspended from the holding means 21.

Subsequently the lift 15 is operated to wind up the wire ropes 16, whereby the truck 12 is moved along the rails 11 with the truck front wheels 13 slightly raised and held in contact with the upper flanges of the rails. This movement turns the pivotal guide rods 7 in the direction of arrow E. Because the front wheels 13 are raised by the wire ropes 16 with the rear wheels 14 held suspended from the holding means 21 in the usual state, the truck will not be prevented from moving by the rear wheels falling into some cavities 11*b* which may be present in the path of the movement. This state is shown in solid lines in FIG. 6. However, if there is the need to lock the pivotal guide rods 7 in the solid-line position, the piston rods of the cylinders 22 are fully extended before the rear wheels 14 reach the pair of cavities 11*b*. This prevents the rear wheels 14 from passing over the cavities 11*b* but allows the wheels 14 to fall into the cavities 11*b* under gravity, whereby the truck 12 and therefore the pivotal guide rods 7 are locked in position automatically. At this time the winding of the wire ropes 16 is discontinued. The tension on the wire ropes 16 of course also acts to hold the truck 12 in the locked position.

Subsequently the winch 27 of the hoisting device 26 is operated to pay off the wire ropes 28, allowing the beam 29 to move down along the pivotal and fixed guide rods 7 and 9. When the hooks 32 on the beam 29 are brought close to the handles 35 on the segment 10 concerned, the beam 29 is temporarily stopped, and the hooks 32 are raised. The beam 29 is then slightly lowered, and the hooks 32 are lowered and engaged with the handles 35.

When the wire ropes 28 are subsequently wound up by operating the winch 27, the segment 10 is hoisted along the fixed guide rods 9 because rolls 39 on the opposite sides of the segment are fitted in and guided by the fixed guide rods 9. The segment 10 is passed through the truck 12 and brought into the space between the pivotal guide rods 7 as shown in FIG. 1, FIG. 2 (in phantom lines), and FIGS. 4 and 5. The holding means 21 is then operated to release the truck 12 from the locked position, and the wire ropes 16 of the lift 15 are loosened, whereupon the truck 12 descends under gravity, allowing the rear wheels 14 of the truck 12 to ride onto the rear end slopes 11*a* of the rails 11. This raises the rear portion of the truck 12, permitting the rolls 18 on the pivotal guide rods 7 to move out from the grooves 20. When the crane 5 is subsequently driven in the direction of arrow B, the rolls 18 move out of the cutouts 19 of the truck 12, with the hooks 23 also moved away from the engaging members 24. Thus the pivotal guide rods 7 are separated from the truck 12. The crane 5 is then moved a specified distance in the direction of arrow B, and the crab 6 is moved in the direction of arrow C. The suspended segment 10 is removed from the hooks 32 and placed on the support 36 as seen in FIG. 2.

A replacement or repaired segment 10 is installed in place by a procedure approximately reverse to the above.

What is claimed is:

1. In continuous casting equipment having a path of transport of castings which is defined by a plurality of roll segments and has a curved section and a horizontal section, an apparatus for hoisting an optional roll segment comprising:

a trolley provided movably above the horizontal section, a pair of pivotal guide rods pivotally supported by the trolley, a pair of fixed guide rods arranged on the opposite sides of each of the roll segments defining the curved section, a pair of fixed circular arc rails extending along the paths of movement of the free ends of the pivotal guide rods, a truck having a pair of front wheels and pair of rear wheels movable on the rails;

means for engaging the truck with the pivotal guide rods, means for reciprocating the truck along the rails together with the pivotal guide rods in engagement with the truck, means for locking the pivotal guide rods in a position where the pivotal guide rods are continuous with a selected pair of fixed guide rods, and means for hoisting a corresponding roll segment along said selected pair of fixed guide rods to the pivotal guide rods when the pivotal guide rods are made continuous with the fixed guide rods, wherein:

the locking means is provided in the form of pairs of recesses formed in the circular arc rails in corresponding relation to the pairs of fixed guide rods, the rear wheels of the truck being positionable in each pair of recesses to lock the truck to the rails so that the pivotal guide rods, when in engagement with the truck, are indirectly locked to the rails in alignment with a corresponding pair of fixed guide rods, and the engaging means comprises a pair of rollers mounted on the free ends of the pivotal guide rods individually, a pair of passage cutouts formed in the rear end of the truck for permitting the rollers to pass therethrough individually, and a pair of elongated engaging grooves formed in the rear end of the truck in communication with the respective cutouts for the rollers to fit in slightly when the truck is in a state for movement but deeply when the truck is locked to the rails.

2. An apparatus as defined in claim 1 wherein the circular arc rails have a center of curvature positioned above the center of curvature of the curved section of the transport path.

3. An apparatus as defined in claim 1 wherein each of the elongated engaging grooves extends along a circular arc centered about the front wheel of the truck.

4. An apparatus as defined in claim 1 which further comprises holding means for preventing the rear wheels of the truck from falling into the recesses.

5. An apparatus as defined in claim 4 wherein the holding means comprises a pair of engaging members provided on the rear end of the truck, and a pair of cylinder assemblies mounted on the pivotal guide rods individually and each having a hook engageable with the corresponding engaging member.

* * * * *